US006905225B2

(12) United States Patent
Pearl

(10) Patent No.: US 6,905,225 B2
(45) Date of Patent: Jun. 14, 2005

(54) FLOODLIGHT AND SPOTLIGHT ADAPTER AND ENCLOSURE

(76) Inventor: George S. Pearl, 2848 Lavista Colony Ct., Decatur, GA (US) 30033

( * ) Notice: Subject to any disclaimer, the term of this patent is extended or adjusted under 35 U.S.C. 154(b) by 41 days.

(21) Appl. No.: 10/457,207

(22) Filed: Jun. 9, 2003

(65) Prior Publication Data

US 2004/0246715 A1 Dec. 9, 2004

(51) Int. Cl.[7] ..... H01R 33/00

(52) U.S. Cl. ..... 362/226; 362/441; 362/457; 439/236; 439/356

(58) Field of Search ..... 439/226, 356, 439/646, 236; 362/226, 267, 268, 441, 457; 313/318.04

(56) References Cited

U.S. PATENT DOCUMENTS

| | | | | | |
|---|---|---|---|---|---|
| 3,878,390 | A | | 4/1975 | Feder | |
| 4,039,821 | A | * | 8/1977 | Greene et al. | 362/217 |
| 4,939,420 | A | * | 7/1990 | Lim | 315/58 |
| 4,956,758 | A | * | 9/1990 | Aubrey et al. | 362/285 |
| 4,958,266 | A | * | 9/1990 | Sorensen et al. | 362/310 |
| 5,073,845 | A | * | 12/1991 | Aubrey | 362/226 |
| 5,251,118 | A | | 10/1993 | Budnovitch et al. | |
| 5,371,661 | A | | 12/1994 | Simpson | |
| 5,386,356 | A | * | 1/1995 | Davis et al. | 362/267 |
| 5,390,096 | A | | 2/1995 | DeKleine et al. | |
| 5,548,494 | A | | 8/1996 | Blackman | |
| 5,580,158 | A | * | 12/1996 | Aubrey et al. | 362/226 |
| 5,660,462 | A | | 8/1997 | Bockley et al. | |
| 6,086,224 | A | | 7/2000 | Sugimoto | |
| 6,554,453 | B2 | * | 4/2003 | Rao | 362/277 |
| 2003/0021103 | A1 | | 1/2003 | Christie | |

* cited by examiner

*Primary Examiner*—John Anthony Ward
(74) *Attorney, Agent, or Firm*—Myers & Kaplan, LLC; Thomas R. Williamson, III, Esq.

(57) ABSTRACT

A lamp adapter comprising a housing with a reflective coating on the inside thereof, a lens, a means for attaching the lens to the housing, a waterproof grommet, and a converter having a female socket and a male plug, wherein the female socket and the male plug have insulated electrical contacts to provide bipolar electrical connection between the female socket and the male plug, such that a light bulb can be inserted into the female socket, and the male plug of the adapter installed in a standard light bulb socket, thereby allowing a variety of different light bulbs to be installed in a weatherproof housing.

20 Claims, 5 Drawing Sheets

FLOODLIGHT AND SPOTLIGHT ADAPTER AND ENCLOSURE

TECHNICAL FIELD

The present invention relates generally to an apparatus and method for providing replacement of lighting instruments by utilizing an adapter housing, and more particularly to an apparatus and method for interchanging lightbulbs within a weather-protected housing.

BACKGROUND OF THE INVENTION

The present invention began out of a need for a device to adapt light bulbs of differing sizes, types and connection methods, such as, for exemplary purposes only, threaded engagement, bayonet engagement, pin contact engagement or otherwise, for use in applications requiring a light bulb having a different connector.

Although various devices and methods of adapting lighting instruments are known, each such device and method possesses inherent disadvantages when compared to the present invention.

Specifically, devices and methods have been described that merely provide an extension to move the point of contact of the bulb remotely from the socket. Other devices are disadvantageous in that they only modify an existing socket to take a shorter bulb or form permanent installations. Other devices are limited to a single type of application.

While some or all of the above-referenced devices may be utilized for providing lighting fixtures, they fail to provide a weatherproof device that effectively permits utilization of differing size and style bulbs and lenses, where users may change the type of bulb or lens to suit their needs, different seasons, different applications or the like.

BRIEF SUMMARY OF THE INVENTION

Briefly described, in a preferred embodiment, the present invention overcomes the above-mentioned disadvantages and meets the recognized need for such a device by providing a method and apparatus for allowing use of light bulbs of different sizes and types in a conventional light fitting suitable for indoor or outdoor use.

More specifically, the present invention in its preferred embodiment is an adapter unit having a housing with a lens cover, wherein the housing permits installation of a light bulb therein via a female socket on the interior thereof. The adapter may be secured within a standard female socket by means of a male connector located on the outer portion of the adapter.

A feature and advantage of the present invention is that it allows different sizes and types of light bulbs to be utilized in different size and type of sockets.

A feature and advantage of the present invention is that it is weatherproof.

A feature and advantage of the present invention is its ability to accommodate different types of lenses, or lenses of different colors.

A feature and advantage of the present invention is its ease of manufacture and low cost of production.

A feature and advantage of the present invention is its ability to replace expensive light bulbs by adapting inexpensive light bulbs to weatherproof conventional sockets.

These and other objects, features and advantages of the present invention will become more apparent to one skilled in the art from the following description and claims when read in light of the accompanying drawings.

BRIEF DESCRIPTION OF THE DRAWINGS

Figure 1A:
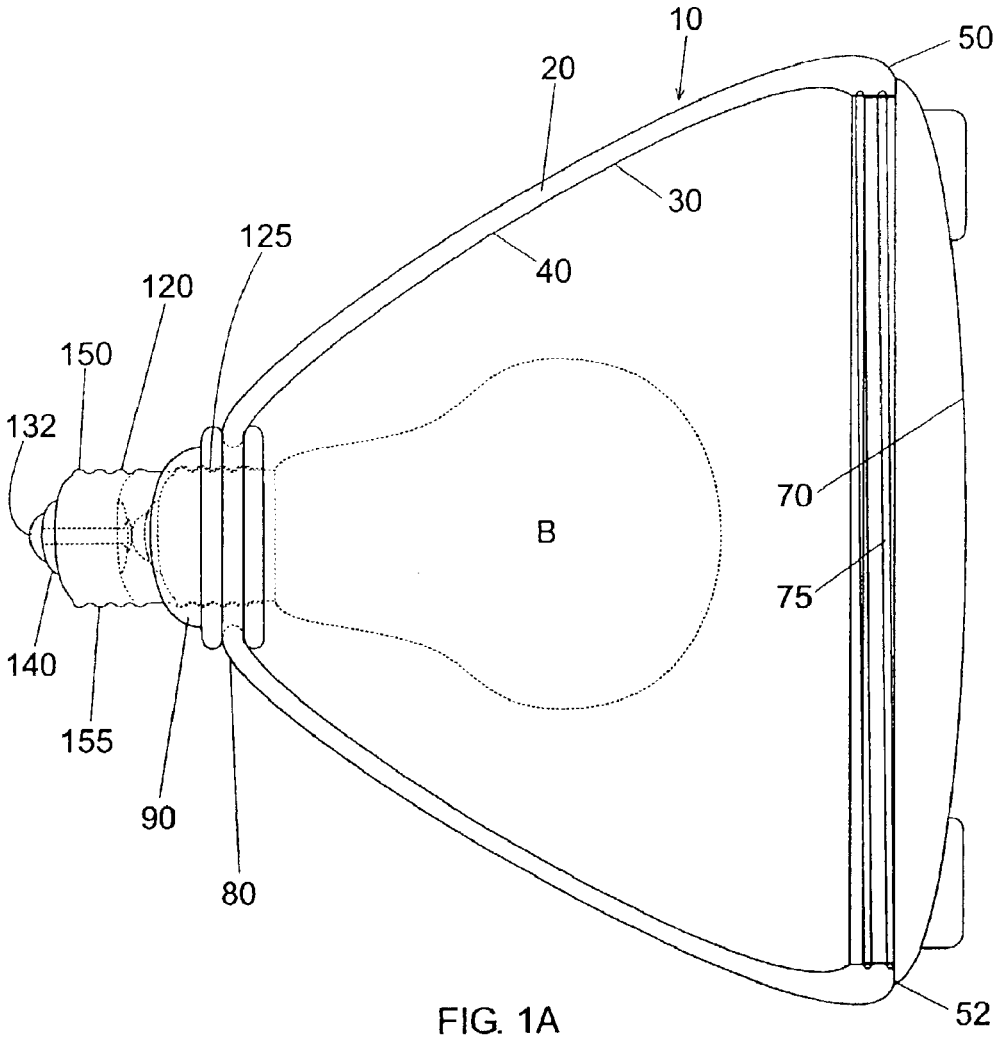
Figure 1B:
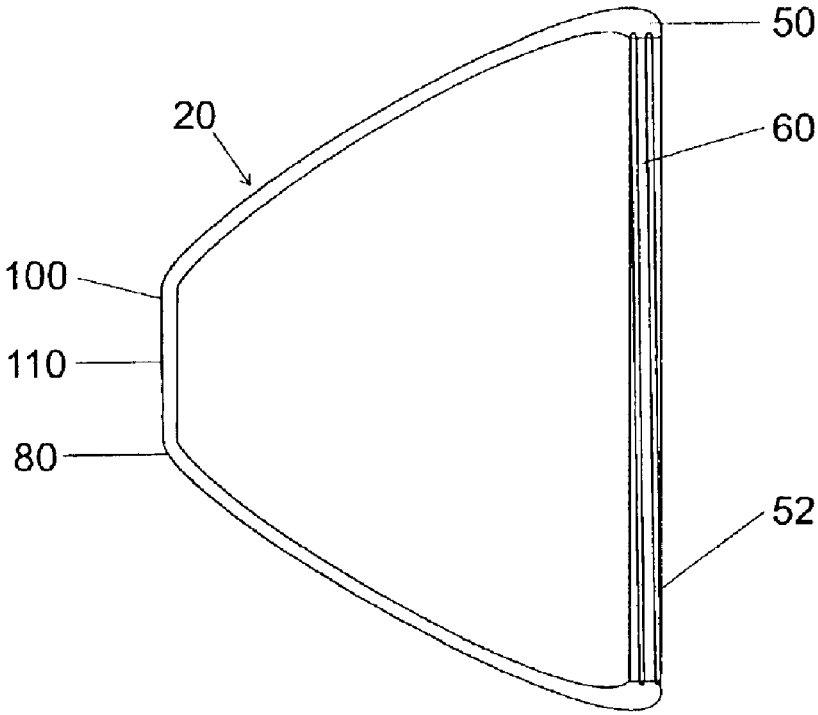

Having thus described the invention in general terms, the present invention will be better understood by reading the Detailed Description of the Preferred and Selected Alternate Embodiments with reference to the accompanying drawing figures, which are not necessarily drawn to scale, and in which like reference numerals denote similar structures and refer to like elements throughout, and in which:

FIGS. 1A and 1B are cross-sectional side views of a device according to a preferred embodiment of the present invention.

Figure 1C:
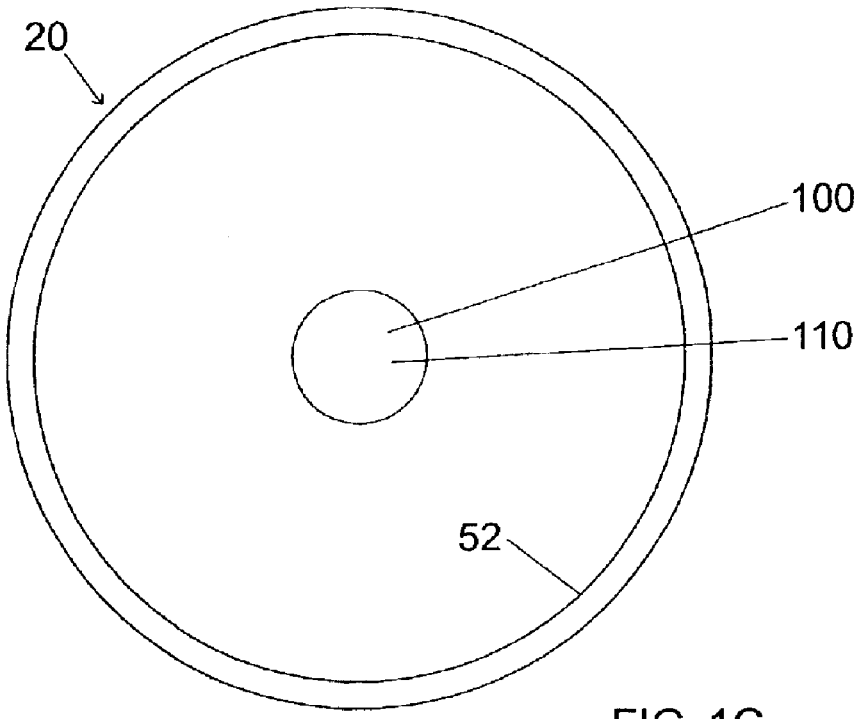

FIG. 1C is a front view of FIG. 1B.

Figure 2A:
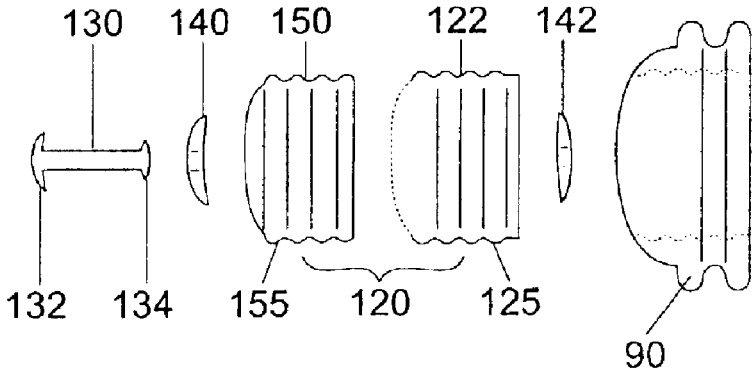

FIG. 2A is an exploded side view of the electrical connection and grommet components of a device according to a preferred embodiment of the present invention.

Figure 2B:
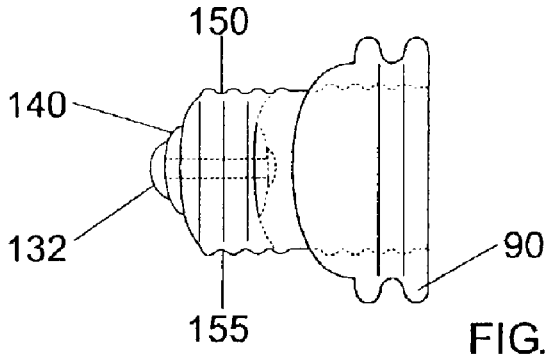

FIG. 2B is a side view of the assembled electrical connection and grommet components of a device according to a preferred embodiment of the present invention.

Figure 2C:
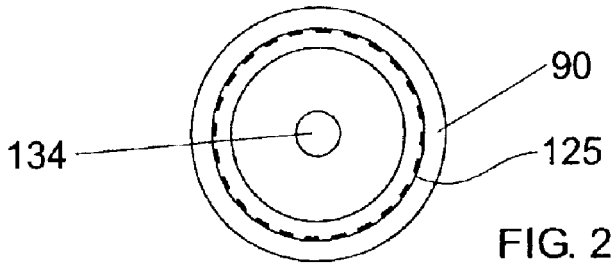

FIG. 2C is a front view of the assembly shown in FIG. 2B.

Figure 2D:
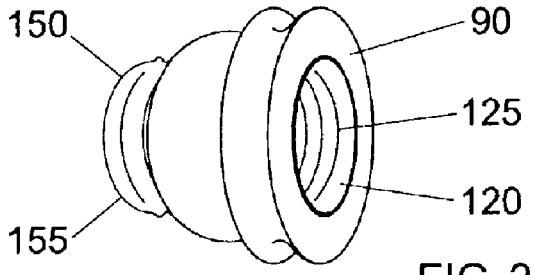

FIG. 2D is a perspective view of the assembly shown in FIG. 2B.

Figure 3A:
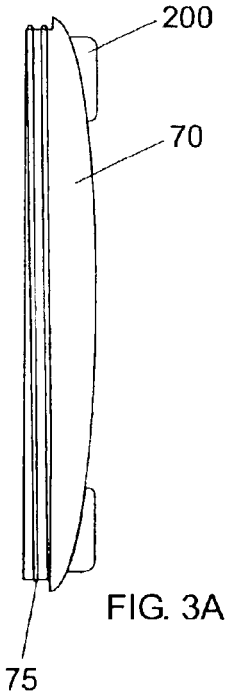
Figure 3B:
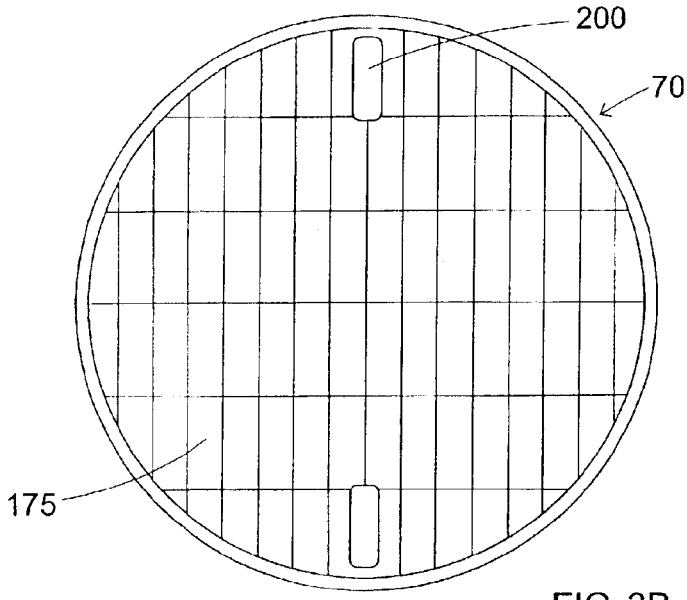

FIGS. 3A and 3B are side and front plan views, respectively, of the lens component of a device according to a preferred embodiment of the present invention.

Figure 4:
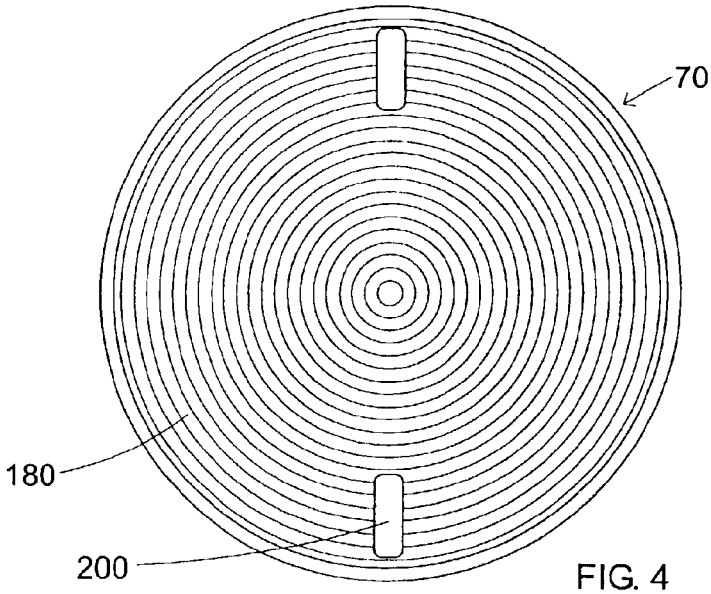

FIG. 4 is a front plan view of an alternative lens component of a device according to a preferred embodiment of the present invention.

Figure 5:
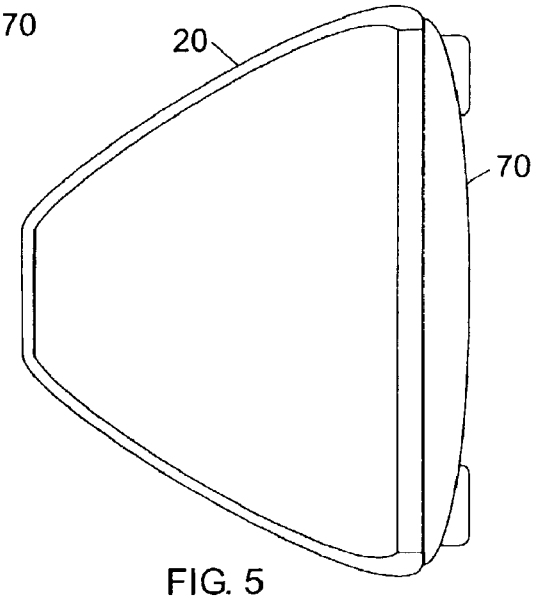

FIG. 5 is a cross-sectional view of an alternative embodiment of the present invention.

Figure 6:
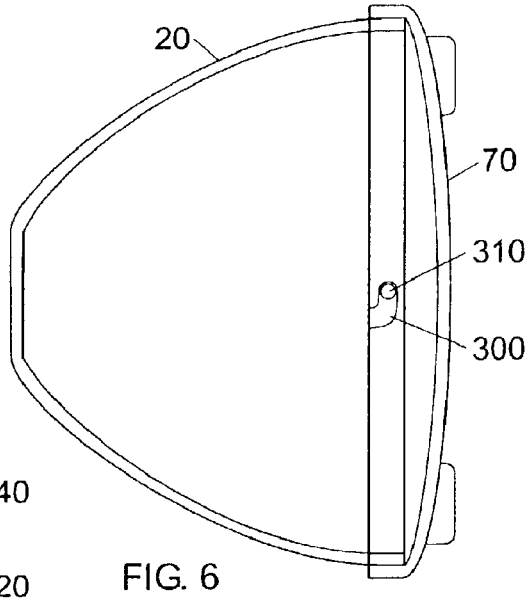

FIG. 6 is a cross-sectional view of an alternative embodiment of the present invention.

Figure 7:
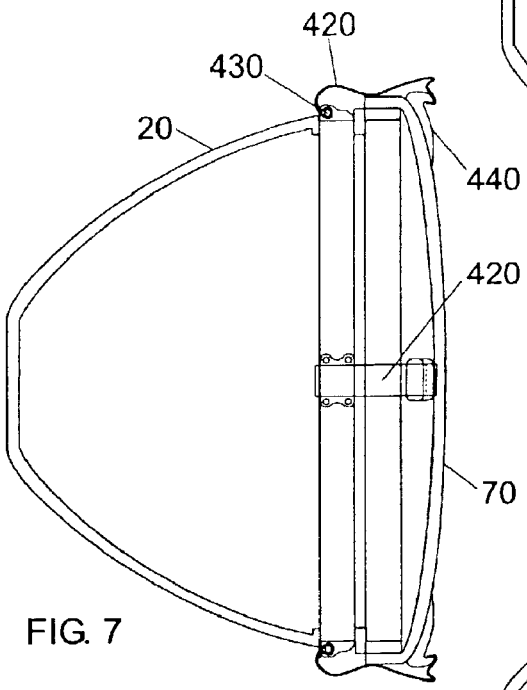

FIG. 7 is a cross-sectional view of an alternative embodiment of the present invention.

DETAILED DESCRIPTION OF THE PREFERRED AND ALTERNATIVE EMBODIMENTS

In describing the preferred and selected alternate embodiments of the present invention, as illustrated in the Figures, specific terminology is employed for the sake of clarity. The invention, however, is not intended to be limited to the specific terminology so selected, and it is to be understood that each specific element includes all technical equivalents that operate in a similar manner to accomplish similar functions.

The present invention is suitable for utilization as a lamp enclosure for replacing indoor and outdoor flood and spotlight bulbs with a standard light bulb. The standard light bulb is contained in a fitting that appears and functions like an outdoor light bulb. The need for such an adapter arises because light bulbs typically may have different envelope sizes, lighting patterns, and connecting interfaces that provide interconnection between a socket and a plug formed on the light bulb. To provide power to the light bulb, the connecting interface provides the matching insulated bipolar electrical connections required to energize the bulbs.

Referring now to FIGS. 1A, 1B and 1C, adapter 10 preferably has diffused glass housing 20 preferably coated with reflective mirrored coating 30 on its interior surface 40.

Preferably formed at first end 50 of housing 20 is opening 52 wherein first end 50 preferably possesses threads 60 formed therein. Threads 60 are preferably adapted to threadably engage threaded lens 70, wherein threaded lens 70 is preferably manufactured from any suitable material, such as, for exemplary purposes only, glass or plastic, and wherein threaded lens 70 further preferably includes threads 75. Threads 75 preferably permit removably attaching lens 70 to housing 20 by threading thereinto.

Second end 80 of housing 20 is preferably formed to accept grommet 90, wherein grommet 90 is preferably made of a suitable weatherproof material, such as, for exemplary purposes only, glass, plastic or rubber. Converter 120 is removably attached within grommet 90 such that threaded male plug shell 150 of converter 120 extends outward and away from second end 80. After removal of lens 70, bulb B is installed within adapter 10 by threading into converter 120, as is further described below. Lens 70 is thereafter preferably threadably reinstalled, and adapter 10 may then be installed into any standard electrical socket by threading threaded male plug shell 150 thereinto.

Housing 20 of adapter 10 is preferably conical. Preferably formed through center 100 of second end 80 of housing 20 is opening 110. Grommet 90 is preferably retained within opening 110 and is preferably held in interference fit therein. Converter 120 is preferably held in interference fit within grommet 90. In an alternative embodiment, grommet 90 may have internally molded threads to accept complementary threads formed on female socket 122 (shown in FIG. 2A) of converter 120.

Referring now to FIGS. 2A, 2B, 2C and 2D, wherein grommet 90 and converter 120 are shown in exploded view. Converter 120 preferably possesses electrically-conductive female socket 122 and male plug shell 150, wherein female socket 122 is preferably inserted within the interior walls of male plug shell 150, and preferably affixed therein via electrically-conductive means, such as, for exemplary purposes only, lead-tin solder. As such, female socket 122 is preferably in electrical communication with threaded male plug shell 150 and forms one pole of an electrical circuit. Alternatively, female socket 122 may be welded or brazed into male plug shell 150, or female socket 122 and male plug shell 150 may be machined out of a single piece of electrically-conductive material. Female socket 122 and male plug shell 150 may be of different sizes and types of connection in order to facilitate adapting different sizes and types of light bulbs between sockets.

The other pole of the electrical circuit required to provide power through adapter 10 preferably includes connector 130. Connector 130 is extends through insulator 140 and preferably extends through center of threaded male plug shell 150 and center of female socket 122. Connector 130 then preferably extends through second insulator 142. Finally connector 130 is preferably secured rigidly in place, preferably via first contact portion 132 and second contact portion 134, which are comprised of any suitable electrically-conductive material, such as for exemplary purposes only, lead-tin solder. Insulators 140 and 142 serve to isolate the electrical pole formed by first contact portion 132, connector 130 and second contact portion 134.

Threaded male plug shell 150 preferably has threads 155 thereon, preferably suitable for insertion and securing of threaded male plug shell 150 within a standard electrical socket. Female Socket 122 preferably has formed therein threads 125, preferably suitable for accepting the desired form of connection for the bulb B that is to be utilized.

Upon installation of adapter 10 in a standard socket, converter 120 will derive power from adapter 10. When bulb B, having a male threaded plug of the same outer dimension as the internal dimension of female socket 122, is installed within converter 120, it is preferably energized with electrical current through first contact portion 132, connector 130, second contact portion 134 and converter 120.

Thus, two poles of the electrical circuit are preferably provided and adapter 10 is preferably energized when threaded male plug shell 150 is preferably retained within an electrical socket of the same dimension.

FIGS. 3A and 3B show a glass cover lens 70 of the present invention preferably having threads 75 molded therein for preferably securing lens 70 within housing 20. Lens 70 further preferably has a plurality of sections 175 for purposes of diffusing light upon energizing bulb B. Lens 70 preferably has tangs 200 to afford a purchase enabling the turning of lens 70 while threading into housing 20. By utilizing a frosted light bulb B within apparatus 10, a diffuse light is readily achieved. In an alternative embodiment, lens 70 may be frosted and bulb B may be clear or frosted in order to produce diffuse light.

Referring now to FIG. 4, illustrated therein is an alternative embodiment of the present invention, wherein cover lens 70 is formed with a plurality of concentric circles 180, or other focusing lens design, in the face thereof in order to provide a spot lighting effect. Concentric circles 180 focus the light reflected by reflective mirrored coating 30. By utilizing a clear light bulb B within apparatus 10, a bright spotlight is readily fashioned.

It is envisioned in alternate embodiments that lens 70 may be attached to housing 20 by other suitable means. For instance, lens 70 may be formed to snap into housing 20 by means of an interference fit when pressed into housing 20, as best illustrated in FIG. 5. In a further alternative embodiment, lens 70 may additionally have a sealing gasket set in place prior to pressing lens 70 into housing 20. Lens 70 may alternatively include curved slots 300 formed therein to engage pins 310 located on housing 20, and lens 70 is thereby locked to housing 20 via pins 310 and slots 300, as best depicted in FIG. 6.

It is contemplated in a further alternative embodiment that housing 20 may be made from any material, such as rubber, glass, plastic or metal.

It is further contemplated in an alternative embodiment that adapter 10 may be made in any size suitably complementary to the size of selected bulb B.

It is contemplated in an additional embodiment that light bulbs having bayonet or pin contacts may be converted to threaded installation via use of adapter 10 wherein female socket 122 of converter 120 would receive bayonet or pin contacts.

It is envisioned in an alternative embodiment that adapter 10 may be fashioned such that female socket 122 of converter 120 is sized and shaped to accept therein any type of bulb connection apparatus.

It is envisioned in an alternative embodiment that adapter 10 may include more than one housing, more than one lens, more than one connector and/or more than one grommet.

It is further envisioned in an alternative embodiment that lens 70 may be attached to housing 20 by a clipping means, such as, for exemplary purposes only, grooves and ridges, or hinges and snaps. FIG. 7 depicts such a suitable clipping means wherein latches 420 include hinge pins 430 suitable for allowing latches 420 to move. Ridges 440 are molded into lens 70. Latches 420 engage ridges 440 and snap thereon, thus securing lens 70 to housing 20.

It is contemplated in an alternative embodiment that a gasket may be utilized to further seal against moisture by placing the gasket over converter 120 prior to installation.

It is further contemplated in an alternative embodiment that opening 52 of housing 20 may take shapes other than circular, such as, for exemplary purposes only, elliptical or rectangular. Accordingly lens 70 will similarly have an elliptical or rectangular shape so as to suitably engage housing 20.

Having thus described exemplary embodiments of the present invention, it should be noted by those skilled in the art that the within disclosures are exemplary only, and that various other alternatives, adaptations, and modifications may be made within the scope of the present invention. Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation. Accordingly, the present invention is not limited to the specific embodiments illustrated herein, but is limited only by the following claims.

What is claimed is:

1. A lamp adapter for use with an electrical socket, said lamp adapter comprising:

at least one housing, having a first opening and a second opening;

at least one lens; wherein said at least one lens further comprises means for focusing;

means for attaching said at least one lens proximal to said first opening of said at least one housing;

at least one waterproof grommet; and at least one converter, wherein said at least one converter comprises a female socket and a male plug shell, said female socket disposed within said male plug shell, and wherein said converter is in electrical communication with the electrical socket.

2. The lamp adapter of claim 1, further comprising means for attaching said at least one converter to said at least one waterproof grommet.

3. The lamp adapter of claim 1, wherein said at least one converter comprises:

at least one female socket having at least two electrical contacts therein, at least one male plug having at least two electrical contacts therein, and at least one insulated bipolar electrical connection between said female socket and said male plug.

4. The lamp adapter of claim 1, wherein said at least one housing is made of a material selected from the group consisting of metal, rubber, glass and plastic.

5. The lamp adapter of claim 1, wherein said at least one lens is made of a material selected from the group consisting of glass and plastic.

6. The lamp adapter of claim 1, wherein said at least one waterproof grommet is made from a material selected from the group consisting of rubber, glass and plastic.

7. The lamp adapter of claim 3, wherein said female socket and said male plug are made of an electrically conductive material.

8. The lamp adapter of claim 1, further comprising a reflective coating.

9. The lamp adapter of claim 8, wherein said reflective coating is selected from the group consisting of aluminum, silver, and alloys thereof.

10. The lamp adapter of claim 1, wherein said means for focusing comprises concentric rings formed in the surface of said at least one lens.

11. The lamp adapter of claim 1, wherein said means for attaching said at least one lens proximal to said first opening of said at least one housing comprises matching complementary threads.

12. The lamp adapter of claim 1, wherein said means for attaching said at least one lens to said first opening of said at least one housing comprises an interference fit.

13. The lamp adapter of claim 1, wherein said means for attaching said at least one lens to said first opening of said at least one housing comprises a clip attachment means.

14. A method of providing lighting comprising the steps of:

a. providing at least one housing, said at least one housing comprising a base portion and a lens opening;

b. installing at least one weatherproof grommet in said base portion of said housing;

c. installing a converter in said at least one weatherproof grommet;

d. inserting a light bulb into said converter;

e. covering said lens opening in said at least one housing with at least one lens, thereby enclosing said light bulb within said at least one housing; and f. inserting said converter into an electrical socket, wherein the step of inserting said converter may take place before or after the step of inserting a light bulb into said converter.

15. The method of claim 14, wherein said at least one lens further comprises means for focusing.

16. The method of claim 15, wherein said means for focusing further comprises concentric rings formed in the surface of said at least one lens.

17. A device for adapting light bulbs to alternative connection formats, said device comprising;

at least one housing having a base portion and a lens opening, wherein said base portion has an opening therein;

at least one weatherproof grommet carried in said base portion of said at least one housing;

at least one converter carried by said at least one weatherproof grommet, said at least one converter comprises at least one male plug and at least one female socket in electrical communication; and at least one lens having means for attachment to said at least one housing.

18. The device of claim 17, wherein said means for attachment of said at least one lens to said at least one housing comprises threads.

19. The device of claim 17, wherein said means for attachment of said at least one lens to said at least one housing comprises an interference fit.

20. The device of claim 17, wherein said at least one lens further comprises means for focusing.

* * * * *